US005678391A

United States Patent [19]

Andersen et al.

[11] Patent Number: 5,678,391

[45] Date of Patent: Oct. 21, 1997

[54] HEATING AND SEALING OF THERMOPLASTIC SURFACES

[75] Inventors: Arve Andersen, Krokstadelva; Per Olaf Tjelflaat, Klaebu; Bjørn Erling Vembe, Hundhammeren, all of Norway

[73] Assignee: Elopak Systems A.G., Glattbrugg, Switzerland

[21] Appl. No.: 521,931

[22] Filed: Aug. 31, 1995

[30] Foreign Application Priority Data

Sep. 2, 1994 [GB] United Kingdom ..... 9417638

[51] Int. Cl.[6] ..... B65B 51/10

[52] U.S. Cl. ..... 53/477; 53/565; 156/499

[58] Field of Search ..... 53/477, 565, 481, 53/370.9, 373.9; 156/497, 499

[56] References Cited

U.S. PATENT DOCUMENTS

| | | | |
|---|---|---|---|
| 3,084,489 | 4/1963 | Seefluth | 53/477 |
| 3,405,505 | 10/1968 | Mistarz | 53/370.9 |
| 3,825,408 | 7/1974 | Farfaglia et al. | 156/497 |
| 4,526,648 | 7/1985 | Tochtermann | 156/497 |
| 4,838,009 | 6/1989 | Connor et al. | 156/497 |
| 5,230,204 | 7/1993 | Mall et al. | 53/477 |

FOREIGN PATENT DOCUMENTS

| | | | |
|---|---|---|---|
| 0649207 | 6/1993 | Australia | 53/370.9 |

*Primary Examiner*—Daniel Moon
*Assistant Examiner*—Gene L. Kim
*Attorney, Agent, or Firm*—Reising, Ethington, Barnard & Perry

[57] ABSTRACT

A hollow heating head for insertion into an open, spouted, top end closure of a carton comprises an interior chamber with slot-form outlets for hot air supplied to the chamber. The slots include a U-shaped, narrow slot, or its equivalent, extending generally horizontally around two lateral vertical walls and an end vertical wall of the head. Each limb of the U-shape includes horizontal, upper and lower sections and a vertical intermediate section. The base of the U-shape is adjacent the lower sections, is at substantially the same level as the lower sections and is of a shallow V-shape in a vertical plane. The slots also include several vertically extending slots above each of the base and the lower sections of the U-shaped slot.

14 Claims, 5 Drawing Sheets

HEATING AND SEALING OF THERMOPLASTIC SURFACES

BACKGROUND OF THE INVENTION

1. Field of the Invention

This invention relates to heating and to sealing of thermoplastic surfaces.

2. Description of the Prior Art

U.S. Pat. No. 3,380,229 discloses a system in which cartons are advanced continuously with their major surfaces substantially horizontal and with respective ends thereof directed unilaterally horizontally, each of those ends being provided with two flaps at respective upper and lower edges of the mouth of the end. Each flap has at least its inner surface of thermoplastics. As the cartons advance, the flaps are folded inwards, so that an inner flap closes the mouth and the outer flap is turned towards the inner flap. In that condition, the flaps pass a row of vertical metal tubes, the inner flaps to one side of the row and the outer flaps to the other side of the row. The tubes are connected to an air manifold and are electrically heated to a temperature in excess of the temperature necessary to render tacky the thermoplastics. Air blown through the tubes renders tacky either the outer surfaces of the inner flaps, or the outer surfaces of the inner flaps and the inner surfaces of the outer flaps, which are then pressed onto the inner flaps to seal the flaps together. The upper ends of the tubes are usually closed, but each tube is formed adjacent its upper end with a longitudinally extending slot forming an elongate air outlet opening.

In sealing the top end closure of a carton formed of paperboard coated on both faces with thermoplastics, with the top end closure comprising a loop of panels, it is known to advance the carton stepwise and, at a dwell, to insert a hollow heating head substantially fittingly into the open closure and to supply hot air into the heating head, whence the hot air is directed, by apertures in vertical walls of the heater head, onto selected parts of the internal surfaces of sealing panels of the end closure to render tacky the thermoplastics of these selected parts. Following removal of the head from the carton, the sealing panels of the end closure are pressed together by sealing jaws to seal the end closure. It is conventional for the apertures in the heater head to be circular, so that the portions upon which the jets of hot air impinge are roughly circular. It is also conventional for the circular apertures to be more densely distributed over internal surface zones which are to be relatively strongly attached together than over internal surface zones which are to be relatively weakly attached together. An array of circular apertures produces a relatively uneven seal, with a risk of leakage between adjacent well-sealed spots.

EP-A-0028941 discloses a gable-topped carton which has its top closure heat-sealed by heating to a tacky consistency, at a first heating stage, those portions of thermoplastics internal surfaces of its lateral sealing panels above the level of the ends of its folded-in sealing panels and thermoplastics internal surfaces of the corner regions among the sealing panels, and, at a second heating stage, the aforesaid portions of the internal surfaces of its lateral sealing panels and thermoplastics external surfaces of the folded-in sealing panels, and then pressure-sealing the tacky surface portions together to form a sealing fin. The heating of the folded-in panel which is to be included in a pouring spout is such that the internal surface thereof is rendered tacky from the adjacent corner regions along to, but not beyond, two score lines intermediate the centre and the respective ends of that panel, which score lines aid in forming the spout. The heating of those portions of the thermoplastics internal surfaces of the lateral sealing panels above the level of the ends of the folded-in sealing panels may be performed at each heating stage by horizontal sheets of hot air emitted through narrow, horizontal slots in lateral walls of the heating head in the stage in question. The heating of the thermoplastics internal surfaces of the corner regions among the sealing panels may be performed by vertical sheets of hot air emitted by vertical slots in the corners of the heating head of the first stage. The heating of the thermoplastics external surfaces of the folded-in sealing panels may be performed by horizontal sheets of hot air emitted from narrow, V-shaped, horizontal slots in transverse, V-shaped, vertical walls of the heating head of the second stage. To prevent the internal surface of that one of the folded-in sealing panels which is to be included in the pouring spout from becoming tacky, that internal surface can be subjected to a horizontal sheet of cold air from a narrow, V-shaped, horizontal slot in a transverse, V-shaped, vertical wall of the heating head of the second stage. Instead of employing hot air heating of the top closure, it is possible to employ radiant heating. It is possible to avoid the need to cool the internal surface of the sealing panel which is to be included in the spout by so designing and controlling the heating means of the apparatus that this internal surface does not attain a temperature at which it becomes tacky.

In an alternative embodiment disclosed in EP-A-0028941, the lateral horizontal slots of the heating head may each take the form of a double row of circular bores, whilst the vertical slots may each be a vertical row of bores. In the second stage, the horizontal V-shaped slots may each be replaced by two V-shaped slots which are each directed downwardly at an angle of about 12° to the horizontal.

A heating head with a relatively large total aperture area and thus with a relatively low exit velocity for the hot air gives good uniform heating of a surface but will also heat surrounding regions excessively. Moreover, cross-wind effects are particularly strong with a heating head substantially fittingly received in the top end closure of a carton, because all of the hot air used for heating the internal surface of the carton must escape through the gap between the heating head and the carton. It is thus highly desirable that the cross-wind velocity should be low compared to the aperture exit velocity, in other words that the total aperture area should be kept as low as reasonably possible.

Where relatively complicated sealing patterns are required, it is usual to employ ultrasonic sealing instead of hot-air or radiant sealing. EP-A-0222511 discloses a spouted, gable-topped carton which has its top closure fin sealed by welding employing an ultrasonic horn and an anvil giving a suitable profile of contour sealing of the fin. There is a straight, continuous, lengthwise seal where the fin is two-ply and a meandering continuous lengthwise seal where it is four-ply, whilst the sealed parts of the four-ply spout portion of the fin are of lesser total extent in proportion to the area of that spout part than are the sealed parts of the other four-ply portion of the fin in proportion to its area.

SUMMARY OF THE INVENTION

New carton materials and new products to be filled increasingly require that the heat transfer to the internal thermoplastics surfaces should be between more narrow temperature limits; moreover, for some products the sealing has to be completely airtight. The products of particular concern are detergents, wine and mineral water.

According to a first aspect of the present invention, there is provided a method of sealing an end closure of a container including a loop of first, second, third and fourth end closure sealing panels, comprising directing hot fluid onto a narrow, band-form part of a thermoplastic inside surface of said end closure to render said band-form part tacky and then folding said first, second, third and fourth end closure sealing panels to cause said band-form part to provide a continuous band of sealing along the inside surfaces of said first, second and third sealing panels.

According to a second aspect of the present invention, there is provided apparatus for use in sealing an end closure of a container including a loop of first, second, third and fourth end closure sealing panels, comprising a narrow slot means of substantially U-shape for directing hot fluid outwardly onto a thermoplastic, narrow, band-form part of substantially U-shape of the inside surface of said first, second and third sealing panels to render said band-form part tacky, and supply means for supplying said hot fluid to said slot means.

Owing to these aspects of the invention, there can be obtained an improvement in the reliability of the fluid-tightness of an end closure sealed by rendering panel parts tacky with hot fluid, folding the panel parts towards each other, and applying pressure to the folded-in panel parts, compared with an end closure where the tacky loop extends over the insides of the first and third sealing panels, but over the outside of the second sealing panel.

According to a third aspect of the present invention, there is provided a method of sealing together first and second, substantially planar, surface zones of which at least the first is of thermoplastic material and extends upwardly, comprising advancing said surface zones along a path, directing towards the first surface zone from narrow slots, and while said surface zones are substantially fixed relative to said slots in the sense of displacement of said surface zones along said path, a plurality of jets of hot fluid which are spaced apart from each other horizontally and which are of elongate cross-section with the longitudinal axes of the cross-sections lying in respective substantially vertical planes, thereby rendering tacky the first surface zone, and then bringing the first and second surface zones together to attach them together.

According to a fourth aspect of the present invention, there is provided apparatus for use in sealing together first and second, substantially planar, surface zones of which at least the first is of thermoplastic material and extends upwardly, comprising a plurality of slots which are spaced apart from each other horizontally and whereof the longitudinal axes extend upwardly and lie in respective substantially vertical planes, for directing hot fluid onto the first surface zone to render the same tacky, a conveyor arranged to advance said surface zones along a path in such manner that time periods when said surface zones are substantially fixed relative to said slots in respect of displacement along said path alternate with time periods when said surface zones advance along said path relative to said slots, and supply means for supplying hot fluid to said slots during the former time periods.

Owing to these aspects of the present invention, there can be obtained an improvement in the strength and evenness of the seal of two surface portions sealed together by rendering at least one tacky with hot fluid, bringing them together and applying pressure to them, compared with such seal obtained using circular-section jets of hot fluid.

According to a fifth aspect of the present invention, there is provided a method of sealing together first and second surface zones of which at least the first is of thermoplastic material, comprising directing hot fluid onto a narrow band-form part of said first surface zone generally inclined to the vertical to render the same tacky and directing hot fluid onto a plurality of individual parts of said first surface zone regularly spaced apart from each other along and above said band-form part to render the same tacky, and then bringing said first and second surface zones together to attach them together at said narrow band-form part and said individual parts.

According to a sixth aspect of the present invention, there is provided apparatus for the use in sealing together first and second surface zones of which at least the first is of thermoplastic material, comprising a narrow slot whereof the longitudinal axis is generally inclined to the vertical for directing hot fluid onto a narrow band-form part of said first surface zone to render the same tacky, a plurality of apertures spaced from each other along and above said slot for directing hot fluid onto a plurality of individual parts of said first surface zone spaced apart from each other along and above said band-form part to render the same tacky, and supply means for supplying said hot fluid to said slot and said apertures.

According to a seventh aspect of the present invention, there is provided in combination, first and second sheet material members having respective first and second surface zones whereof at least the first surface zone is of thermoplastic material, said first surface zone including a narrow, band-form part attached throughout its length to said second surface zone and also including a plurality of individual parts regularly spaced from each other along and above said band-form part and attached to said second surface zone.

According to an eighth aspect of the present invention, there is provided a method of sealing an end closure of a container, said end closure comprising an inner loop of obturating panels for obturating the end of the container and an outer loop of sealing panels for forming a sealing fin, the sealing panels comprising first and second, oppositely disposed, lateral panels having thermoplastic internal surfaces and first and second, oppositely disposed, folded panels having thermoplastic internal surfaces and whereof the first folded panel is to be comprised in a pouring spout and of which the internal surface of the first lateral panel consists of two side-by-side segments one of which is to be relatively weakly attached to an opposite surface and the other of which is to be relatively strongly attached to another opposite surface, comprising directing hot fluid onto only a single portion of the one segment which portion is of narrow band form, is generally inclined to the vertical and extends from one end zone to the opposite end zone of said one segment, to render said single portion tacky, directing hot fluid onto one or more parts of the other segment which is or are of an area or total area greater than the area of said single portion and which comprise(s) a second band-form portion generally inclined to the vertical and extending from one end zone of said other segment to the opposite end zone thereof, to render said one or more parts tacky, and then bringing said internal surface of the first lateral panel together with the opposite surfaces to attach them together at said single portion and said one or more parts.

According to a ninth aspect of the present invention, there is provided apparatus for use in sealing an end closure of a container, which end closure comprises an inner loop of obturating panels for obturating the end of the container and an outer loop of sealing panels for forming a sealing fin, the sealing panels comprising first and second, oppositely disposed, lateral panels having thermoplastic internal surfaces and first and second, oppositely disposed, folded panels having thermoplastic internal surfaces and whereof the first folded panel is to be comprised in a pouring spout and of which the internal surface of the first lateral panel consists of two side-by-side portions one of which is to be relatively weakly attached to an opposite surface and the other of which is to be relatively strongly attached to another opposite surface, comprising one narrow slot length generally inclined to the vertical for directing hot fluid onto only a single part of the one portion which part is of narrow band form, is generally inclined to the vertical and extends from one end zone to the opposite end zone of said one portion, to render said single part tacky, one or more apertures of an area or total area greater than that of said slot length for directing hot fluid onto one or more parts of the other portion which is or are of an area or total area greater than the area of said single part and said one or more apertures comprising another narrow slot length generally inclined to the vertical for directing hot fluid onto a band-form part of the other portion generally inclined to the vertical and extending from one end zone of said other portion to the opposite end zone thereof, to render said one or more parts tacky, and supply means for supplying said hot fluid to said one slot length and said one or more apertures.

Owing to these aspects of the present invention, it is possible to provide a hot-fluid system in which there is discrimination between surface zones which should essentially be sealed together in an air-tight manner and surface zones which should essentially be attached together for increased strength.

According to a tenth aspect of the present invention, there is provided a method of heating a thermoplastic surface to render the same tacky, comprising supplying hot fluid to a slot which is directed towards said surface and which is of a width W and is spaced a distance H from the surface, with H/W being no less than 1, to cause the slot to direct hot fluid onto the surface to render the same tacky, with the Reynolds number being no more than 10,000.

The slot can be substantially vertical and directed substantially horizontally or substantially horizontal and directed substantially horizontally.

Owing to this aspect of the present invention, there can be obtained heating of the surface without large local relative differences in heat transfer coefficient within the impingement area.

Advantageously, H/W is between 1 and 10, preferably about 5, whilst the Reynolds number (Re) is preferably between 1,000 and 2,000.

We have found that a slot-form aperture has a heat transfer coefficient comparable to that of a round aperture. We have also found that a single slot-form aperture which is generally horizontal can produce uniform heating in the length direction of the slot, but that the sheet of hot air emitted by the slot is strongly influenced by crosswinds produced by hot fluid rising from any apertures below it. In practice, we use horizontal, slot-form apertures where there is expected to be little cross-wind effect and circular-form or vertical, slot-form apertures where strong cross-wind effect is expected.

In a preferred embodiment, a single, generally horizontal, slot-form aperture, or its equivalent in the form of a plurality of generally horizontal, slot-form apertures, is provided in each of two vertical lateral walls and one of two vertical end walls of a heating head. It produces a band-form tacky part on a lateral or end sealing panel of a top end closure of a carton formed of paperboard coated on both faces with thermoplastics and this band-form part is used for airtight sealing. Where it is desired to increase the strength of the attachment, round apertures and/or vertical slot apertures are provided above the single, generally horizontal, slot form aperture or its equivalent.

BRIEF DESCRIPTION OF THE DRAWINGS

In order that the invention may be clearly understood and readily carried into effect, reference will now be made, by way of example, to the accompanying drawings, in which.

DESCRIPTION OF THE PREFERRED EMBODIMENTS

Figure 3:
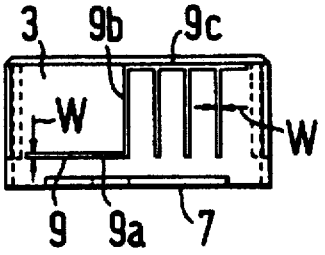
FIG. 3 shows an opposite lateral elevation of that main part.
Figure 5:
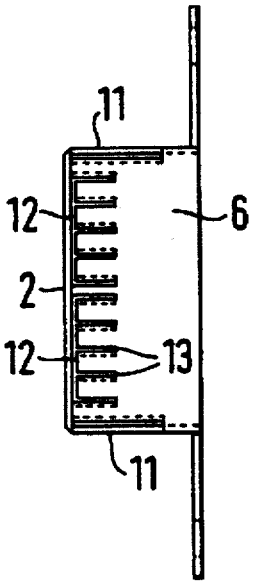
FIG. 5 shows a rear elevation of that main part.
Figure 1:
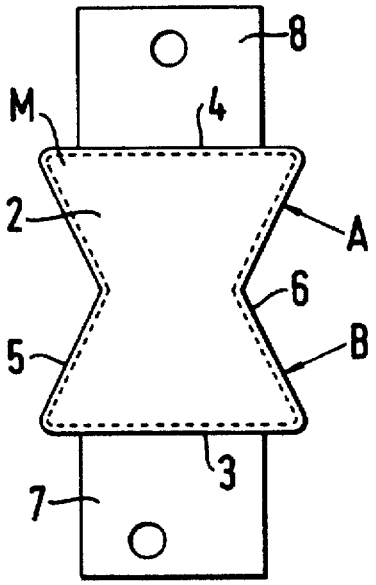
FIG. 1 is an underneath plan view of a main part of a top closure heating head of a carton forming, filling and sealing machine.
Figure 4:
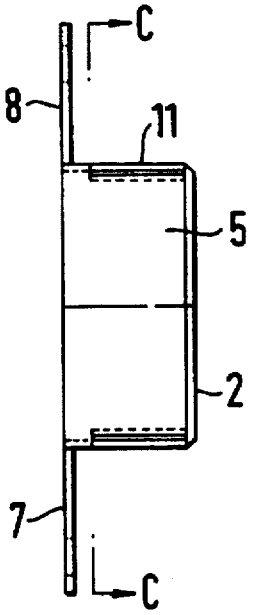
FIG. 4 shows a front elevation of that main part.
Figure 2:
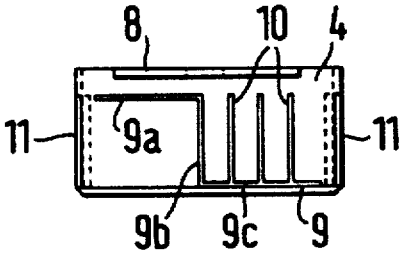
FIG. 2 shows a lateral elevation of the main part.
Figure 6:
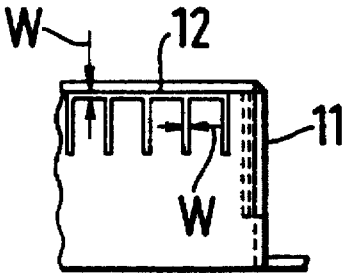
FIGS. 6 and 7 show elevations taken in the directions of the arrows A and B in FIG. 1, respectively.
Figure 7:
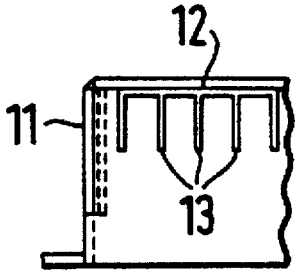

Referring to FIGS. 1 to 8, the main part M of the heating head comprises an open-topped chamber 1 bounded by an imperforate, horizontal, bottom wall 2, and a vertical skirt consisting of two perforate, lateral walls 3 and 4 identical to each other, a substantially imperforate, V-shaped, front wall 5 and a perforate, V-shaped, rear wall 6. Fixed to the respective walls 3 and 4 are two horizontal lugs 7 and 8 whereby the main part M is attachable to a vertically reciprocating support (not shown). Formed through each of the walls 3 and 4 is a narrow, generally horizontal slot 9 extending from one end zone to the opposite end zone of the wall. The slot 9 consists of an upper horizontal length 9*a*, a vertical intermediate length 9*b* and a lower horizontal length 9*c*. Also formed through each wall 3 or 4 are three narrow, vertical slots 10 communicating directly with the slot length 9*c* and regularly spaced apart from each other and from the vertical slot length 9*b* along the slot length 9*c*. Formed through the corners of the vertical skirt 3 to 6 are respective narrow, vertical slots 11. Formed through each of the two limbs of the V-shaped wall 6, at a location near the bottom wall 2 is a narrow, horizontal slot 12 extending from one end zone to the opposite end zone of the limb. Formed through each limb are also five narrow, vertical slots 13 communicating directly with the slot 12 and regularly spaced apart along the slot 12.

Figure 8:
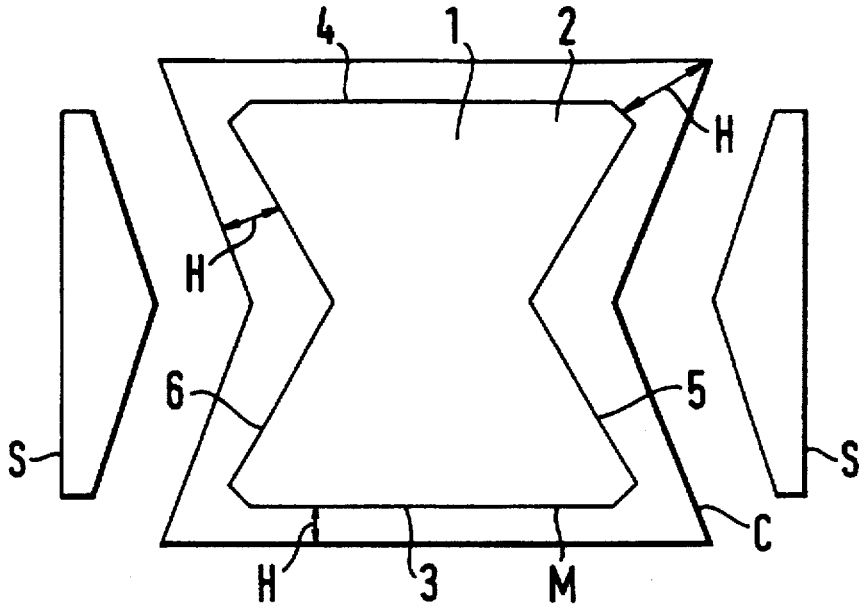
FIG. 8 shows a section taken on the line C—C of FIG. 4 through not only the main part of the head but also two subsidiary parts thereof and a carton.
Figure 9:
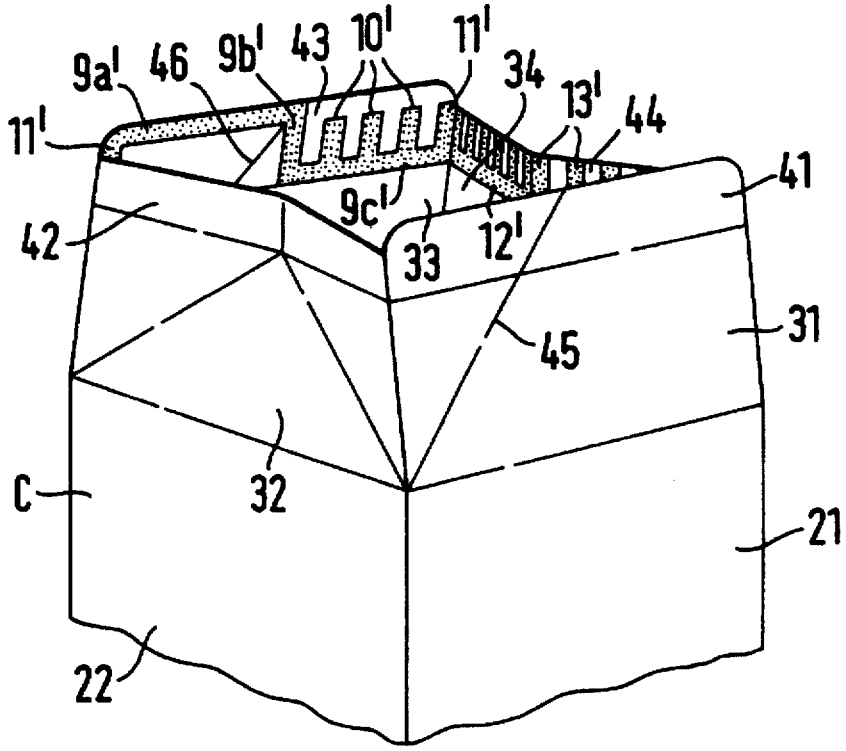
FIG. 9 is a top perspective view of a top end closure of the carton ready to be received by the heating head.

In use, the heating head is lowered to receive the top closure of the carton C shown in FIGS. 8 and 9. The carton is formed from paperboard coated on both faces with thermoplastics and consists of a sealed bottom closure (not shown), four body panels (of which two are seen and referenced 21 and 22), four top closure obturating panels 31 to 34 and four top closure sealing panels 41 to 44. The panels 41 to 44 are sealed together to form a sealing fin, the pre-broken and thus V-shaped fold-in panels 42 and 44 being sandwiched between the lateral panels 41 and 43 in the fin itself. The panels 32 and 42 are intended to form a pouring spout and, from the two corners where the panel 32 meets the panel 22, two score lines 45 and 46 extend obliquely upwards over the panels 31 and 41 and 33 and 43, respectively, to about the middles of the top edges of the panels 41 and 43 and serve to facilitate folding-out of the pouring spout panels 32 and 42 when the sealed top end closure is later opened by the consumer. In the pre-broken condition of the end closure shown in FIGS. 8 and 9, the heating head is lowered until the main part M is received in the open top closure. Hot air is fed to the chamber 2 and thence the slots 9 to 13 to direct the hot air in horizontal and vertical sheets onto the internal surfaces of the sealing panels to provide the tacky pattern partially shown diagrammatically by shading in FIG. 9. It will be noted that, over the front half of the internal surface of the lateral panel 43, for example, there is substantially no tacky area bar a vertical front corner strip 11' formed by the relevant front slot 11, a single horizontal tacky band length 9*a*' formed by the horizontal slot length 9*a*, and a vertical tacky band length 9*b*' formed by the vertical slot length 9*b*. It will also be seen that the rear half of the internal surface of the panel 43, for example, is not only formed with vertical and horizontal tacky band lengths 9*b*' and 9*c*' corresponding to the slot lengths 9*b* and 9*c*, but also with tacky vertical strips 10' corresponding to the vertical slots 10 and a tacky vertical rear corner strip 11' corresponding to the relevant rear slot 11. It will also be noted that the internal surface of the panel 44 is formed with the horizontal tacky bands 12' and vertical tacky strips 13' corresponding to the slots 12 and 13, respectively. The horizontal distribution of the slots 10 and 13 is such that, when the relevant limb of the V-shaped panel 44 is pressed against the internal surface of the panel 43, the vertical tacky strips 10' and 13' roughly coincide and so provide a strong attachment. It will also be noted that the internal surface of the relevant limb of the V-shaped panel 42 has no tacky area thereof apart from its corner region adjacent the panel 43 and thus, when pressed against the panel 43, remains substantially unadhered thereto except at the front vertical strip 11' and the vertical band length 9*b*'. The horizontal band length 9*a*' seals against the corresponding band length 9*a*' on the internal surface of the panel 41.

Figure 15:
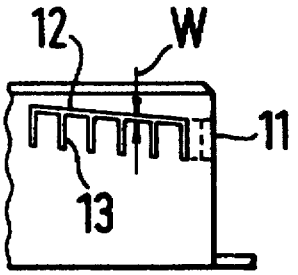
FIGS. 10 to 16 are views similar to FIGS. 1 to 7, respectively, of a modified version of the main part of the heating head.
Figure 16:
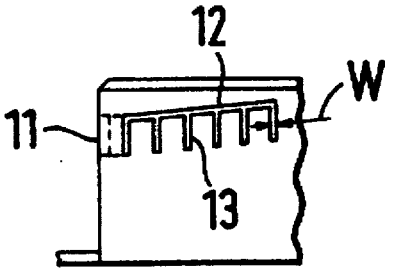
Figure 12:
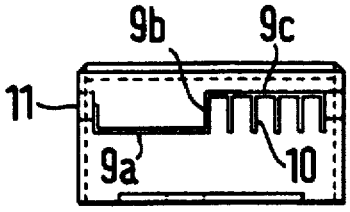
Figure 14:
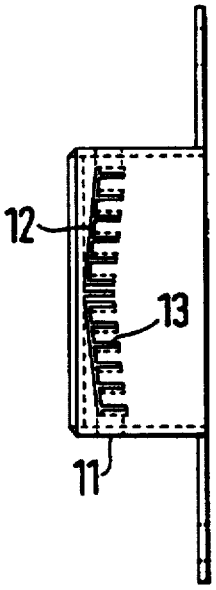
Figure 10:
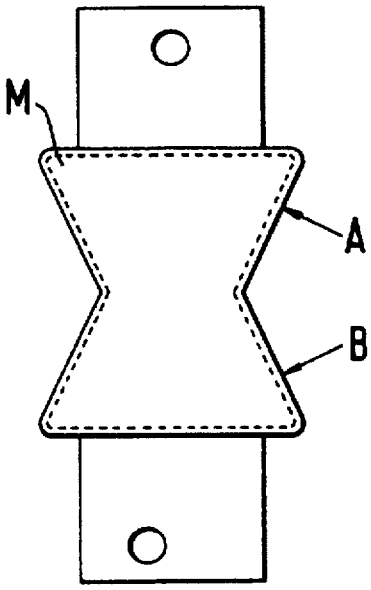
Figure 13:
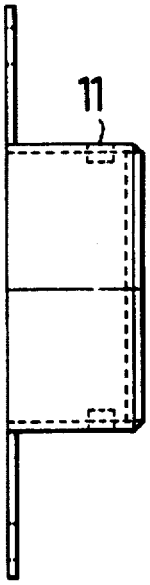
Figure 11:
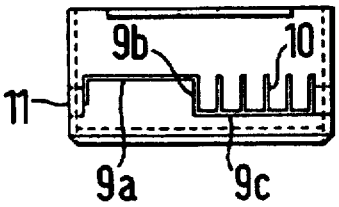

We believe that the modified version shown in FIGS. 10 to 16 gives more accurately located heating of the top closure sealing panels 41 to 44. Referring to FIGS. 11 and 12, it will be noted that the slot lengths 9*c* have been displaced upwards and the slot lengths 9*a* displaced downwards relative to the same slot lengths in FIGS. 2 and 3, whilst the slot lengths 9*b* and 10 have been correspondingly shortened so as to extend over only about one-quarter to one-third of the height of the walls 3 and 4. Referring to FIGS. 11 to 16, it will be noted that the slots 11 have also been correspondingly shortened. As seen in FIGS. 14 to 16, the slots 12 have been displaced so as to extend obliquely upwards towards the respective adjacent corner slots 11 at an angle to take account of the fact that, in the pre-broken condition of the panel 44, its lowermost central point is at a lower level than its lowermost end points, i.e. the boundary between the panels 34 and 44 is of a shallow, cranked, V-form with the centre of the V at a lower level than the ends of the V.

FIG. 8 shows the main part M of the heating head with the subsidiary parts S of the head. The V-shaped vertical walls of the subsidiary parts S are formed with a plurality of vertical slots (not shown) through which hot air is directed onto the external surfaces of the panels 42 and 44 to render them tacky.

It will be appreciated that, for example, the panels 42 and 43 are relatively weakly attached together, the effect of the slot length 9*a* being to provide an airtight seal, whilst, for example, the panels 43 and 44 are relatively strongly attached together, with the effect of the slot length 9*c* being to provide an airtight seal. The positioning of the slots 10 above each slot length 9*c* (and of the slots 13 above each slot 12) ensures that they do not produce upward crosswinds out of the mouth of the carton which interfere with the horizontal sheet of hot air directed from the slot length 9*c* (and the slot 12). Moreover, the spacings among the slots 10 (and 13) enable hot air from the slot length 9*c* (and the slot 12) to escape upwards without interfering with the effectiveness of the slots 10 (and 13).

An advantage of heating a narrow band of, say, a few millimetres, is that it provides a good airtight seal but at relatively low temperature because of the small heating area involved. The slots 9 to 13 are preferably less than about 2 mm. in width W. In fact, the slots 9 to 13 are preferably about 1 mm. in width W, except for the corner slots 11 which, to account for the greater distance between the board and the heating head in the corners of the carton, may be of about 2 mm. width W. In respect of any one of the slots 9 to 13 the ratio of the distance H from the facing surface to be heated to the width W of the slot is about 5, while the Reynolds number (Re) of the air flow through the slot is substantially 1,500, which values we believe give a relatively even heat transfer coefficient over the impingement area, so giving even sealing over that area.

By the use of the present heating head, it is possible to obtain uniform local heat transfer coefficients at least four times higher for the particular attachment areas required than for the surrounding regions.

Figure 17:
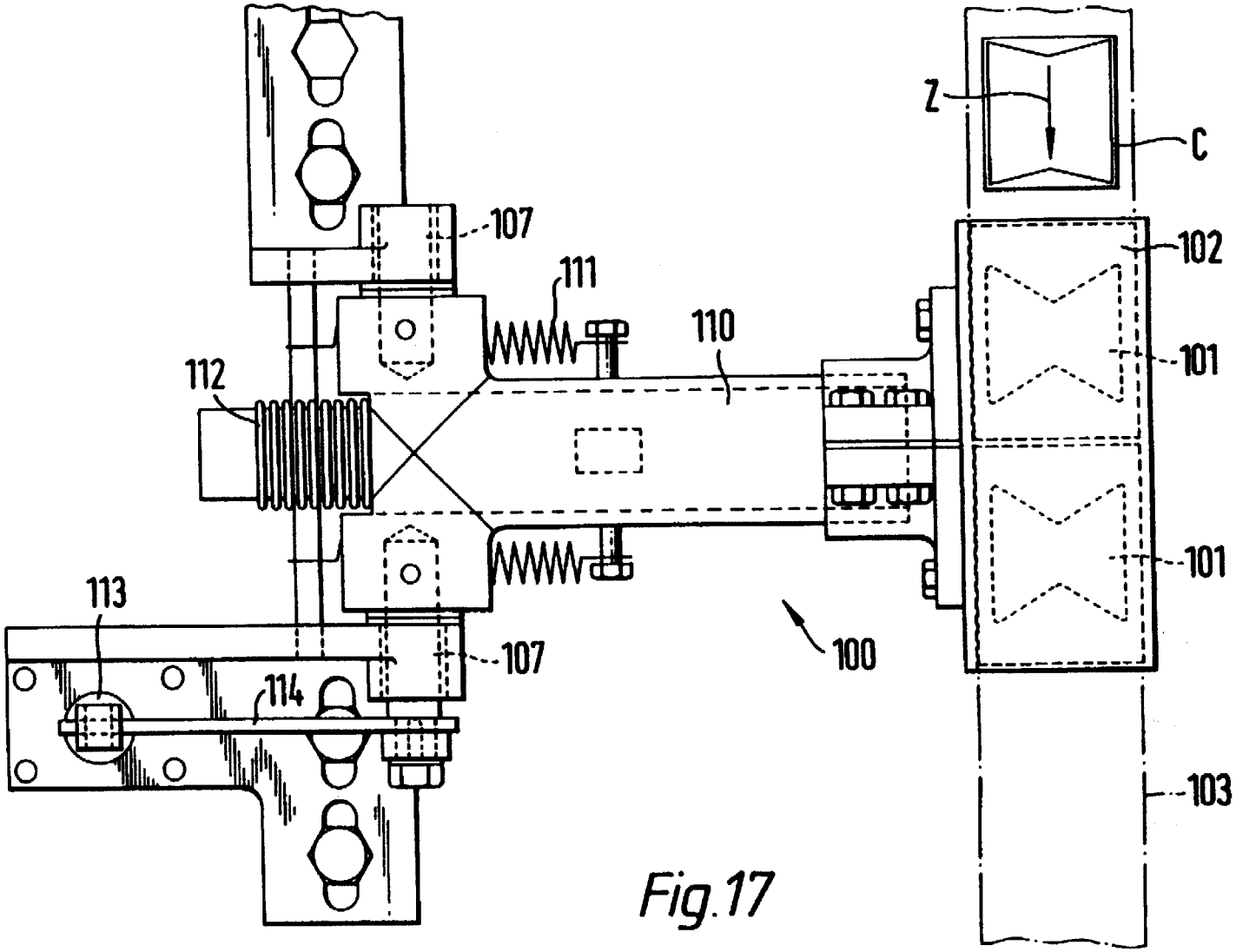
FIG. 17 is a top plan view of a top closure heating station of the machine.

Referring to FIG. 17, pairs of cartons C are advanced stepwise in the direction of the arrow Z through the heating station 100, which acts simultaneously upon both cartons of a pair. The station 100 includes two identical heating heads 101 each according to FIGS. 1 to 8, or FIGS. 10 to 16, mounted in a casing 102.

The cartons C are advanced stepwise in pairs by an indexing chain conveyor diagrammatically indicated at 103. The casing 102 is raised and lowered about co-axial pins 107 and in synchronism with the stepwise advance of the cartons C by means of a rotary cam (not seen) acting on a roller follower (not seen) carried by a tubular arm 110 mounting and communicating with the casing 102. The cam raises the heads 101 just clear of the cartons advancing therebelow. Springs 111 urge the follower to bear continuously against the cam. The interior of the arm 110 communicates via a bellows hose 112 with a fixed hot-air supply pipe (not shown) and supplies the hot air to the hollow interior of the casing 102 and thus the heads 101. In FIG. 8 an end plate of the head 100 has been removed for ease of understanding. If and when, during operation, the stepwise carton advance is discontinued for some reason, for example automatically on misalignment of a carton, a pneumatic piston-and-cylinder device 113 is automatically actuated to swing an arm 114 downwardly about the pins 107. The arm 114 is fixed to the tubular arm 110. The arm 114 is swung downwardly through an angle sufficient to lift the heads 101 well clear of the cartons C therebelow, so as to avoid the hot air being continually fed to the stationary cartons and their contents. With resumption of the stepwise advance of the cartons, the device 113 allows the heads 101 to return to their operational positions.

We claim:

1. A method of sealing an end closure of a container, comprising providing an end closure of a container including a loop of first, second, third and fourth end closure sealing panels, directing hot fluid onto a narrow, band-form part of a thermoplastic inside surface of said end closure to render said band-form part tacky and then folding said first, second, third and fourth end closure sealing panels to cause said band-form part to provide a continuous band of sealing along the inside surfaces of said first, second and third sealing panels A said directing comprising producing a jet of hot fluid of elongate cross-section and applying said jet to said narrow band-form art such that said elongate cross-section and said narrow band-form part are elongate and substantially parallel to each other.

2. A method according to claim 1, wherein, during said directing, said first, second, third and fourth end closure sealing panels extend upwardly, said directing being accompanied by directing towards a surface zone above said narrow band-form part a plurality of jets of hot fluid which are spaced apart from each other horizontally, thereby rendering said surface zone tacky.

3. A method according to claim 2, wherein said jets of hot fluid are of elongate cross-section with the longitudinal axes of the cross-sections lying in respective substantially vertical planes.

4. A method according to claim 1, wherein said end closure comprises an inner loop of obturating panels for obturating the end of the container and an outer loop of said sealing panels for forming a sealing fin, the first and third sealing panels comprising oppositely disposed, lateral panels having thermoplastic internal surfaces and the second and fourth sealing panels comprising oppositely disposed, folded panels having thermoplastic internal surfaces and whereof the fourth sealing panel is to be comprised in a pouring spout and of which the internal surface of the first sealing panel consists of two side-by-side segments one of which is to be relatively weakly attached to an opposite surface and the other of which is to be relatively strongly attached to another opposite surface, said directing comprising directing hot fluid onto only a single portion of the one segment which portion is of narrow band form, is generally inclined to the vertical and extends from one end zone to the opposite end zone of said one segment, to render said single portion tacky, and directing hot fluid onto one or more parts of the other segment which is or are of an area or total area greater than the area of said single portion and which comprise(s) a second band-form portion generally inclined to the vertical and extending from one end zone of said other segment to the opposite end zone thereof, to render said one or more parts tacky.

5. A method according to claim 1, wherein said directing is performed by slot means which is directed towards said inside surface and which is of a width W and is spaced a distance H from said inside surface, with H/W being no less than 1, and with the Reynolds number of the fluid flow through the slot means being no more than 10,000.

6. A method according to claim 5, wherein said directing is substantially horizontal.

7. A method according to claim 5, wherein said H/W is between 1 and 10.

8. A method according to claim 7 wherein said H/W is about 5.

9. A method according to claim 5, wherein said Reynolds number is between 1,000 and 2,000.

10. A method according to claim 6, wherein, during said directing, said first, second, third and fourth end closure sealing panels extend upwardly, said directing being accompanied by directing towards an inside surface zone above said narrow-band-form part a plurality of jets of hot fluid which are spaced apart from each other horizontally and which are of elongate cross-section with the longitudinal axes of the cross-sections lying in respective substantially vertical planes, thereby rendering tacky said surface zone, said directing of said plurality of jets being performed by other slot means which is substantially vertical and directed substantially horizontally, said other slot means being directed towards said inside surface and being of a width W and being spaced a distance H from said inside surface, with H/W being no less than 1, and with the Reynolds number of the fluid flow through said other slot means being no more than 10,000.

11. A method according to claim 10 wherein each said H/W is between 1 and 10.

12. A method according to claim 11, wherein each said H/W is about 5.

13. A method according to claim 10, wherein each said Reynolds number is between 1,000 and 2,000.

14. A method of sealing an end closure of a container, comprising providing an end closure of a container comprising an inner loop of obturating panels for obturating the end of the container and an outer loop of sealing panels for forming a sealing fin, the sealing panels comprising first and second, oppositely disposed, lateral panels having thermoplastic internal surfaces and first and second, oppositely disposed, folded panels having thermoplastic internal surfaces and whereof the first folded panel is to be comprised in a pouring spout and of which the internal surface of the first lateral panel consists of two side-by-side segments one of which is to be relatively weakly attached to an opposite surface and the other of which is to be relatively strongly attached to another opposite surface, comprising directing hot fluid onto only a single portion of the one segment which portion is of narrow band form, and extends from one end zone to the opposite end zone of said one segment, to render said single portion tacky, said directing comprising producing a jet of hot fluid of elongate cross-section and applying said jet to said single portion such that said elongate cross-section and said single portion are elongate and substantially parallel to each other directing hot fluid onto one or more parts of the other segment which is or are of an area or total area greater than the area of said single portion and which comprise(s) a second band-form portion and extending from one end zone of said other segment to the opposite end zone thereof, to render said one or more parts tacky, the latter directing comprising producing one or more jets of hot fluid of or each of elongate cross-section and applying said one or more jets to said one or more parts such that said one or more parts and the elongate cross-section(s) of said one or more jets are elongate and substantially parallel each other, and then bringing said internal surface of the first lateral panel together with the opposite surfaces to attach them together at said single portion and said one or more parts.

* * * * *